US005242118A

United States Patent [19]

Schmidt et al.

[11] Patent Number: 5,242,118

[45] Date of Patent: Sep. 7, 1993

[54] FUEL INJECTOR FOR INTERNAL COMBUSTION ENGINES

[75] Inventors: Harald Schmidt; Theodor Kauba, both of Vienna; Josef Morell, Tulpinger Kogl, all of Austria

[73] Assignee: Steyr-Daimler-Puch Ag, Vienna, Austria

[21] Appl. No.: 906,104

[22] Filed: Jun. 26, 1992

Related U.S. Application Data

[63] Continuation of Ser. No. 568,470, Aug. 16, 1990, abandoned.

[30] Foreign Application Priority Data

Aug. 17, 1989 [AT] Austria ..... 1951/89

[51] Int. Cl.[5] ..... F02M 45/00

[52] U.S. Cl. ..... 239/533.4; 239/533.9

[58] Field of Search ..... 239/533.2–533.12, 239/583, 584

[56] References Cited

U.S. PATENT DOCUMENTS

| | | | |
|---|---|---|---|
| 4,168,804 | 9/1979 | Hofmann . | |
| 4,470,548 | 9/1984 | Ushimura | 239/533.3 |
| 4,715,541 | 12/1987 | Freudenschuss et al. . | |
| 4,819,871 | 4/1989 | Kronberger et al. | 239/533.3 |
| 4,846,114 | 7/1989 | List | 239/533.3 |
| 4,934,599 | 6/1990 | Hasagawa | 239/533.8 |

FOREIGN PATENT DOCUMENTS

| | | | |
|---|---|---|---|
| 2025569 | 5/1970 | Fed. Rep. of Germany . | |
| 2710217 | 9/1978 | Fed. Rep. of Germany | 239/533.2 |
| 2841967 | 4/1980 | Fed. Rep. of Germany . | |
| 2352957 | 12/1977 | France . | |
| 402510 | 5/1966 | Switzerland . | |
| 2223270 | 4/1990 | United Kingdom | 239/533.4 |

OTHER PUBLICATIONS

Patent Abstracts of Japan, vol. 13, No. 300, "Fuel Injection Nozzle", (M-848)(3648) Jul. 11, 1989.

Automotive Engineering, vol. 87, No. 11, Nov. 1979 Warrendale US Seiten 59-62; K. L. Hulsing: Diesel Injector Sprays Fuel in Sweep Pattern.

*Primary Examiner*—Andres Kashnikow
*Assistant Examiner*—Christopher G. Trainor
*Attorney, Agent, or Firm*—Marmorek, Guttman & Rubenstein

[57] ABSTRACT

A fuel injector for internal combustion engines comprises a nozzle body, having at one end a hollow nozzle tip and a pintle which is axially movable in the nozzle body. The inside surface of the hollow nozzle tip constitutes a conical valve seat which cooperates with a conical valve surface of the pintle to form a valve that is spring-urged closed. The nozzle tip is formed with at least one discharge bore along its inside surface. The inside surface of the nozzle tip terminates in a first sharp edge leading into a blind bore. The conical valve surface of the pintle is terminated adjacent to the blind bore by a second sharp edge. To improve the atomization of fuel delivered by the fuel injector, the distance from the center of an entrance opening of the discharge bore to the nearer of the first and second sharp edges is not in excess of one and one-half times the diameter of the entrance opening, while the distance to the other sharp edge is equal to or greater than one and one-half times the diameter of the entrance opening. If two or more discharge bores are provided, the distance between the centers of the entrance openings, measured along the surface of the valve seat, is not in excess of three and one-half times the diameter of the entrance opening. In a preferred embodiment, movement of the pintle is opposed by two springs acting in series, so that the pintle is moved away from the nozzle tip in two lifting phases.

12 Claims, 5 Drawing Sheets

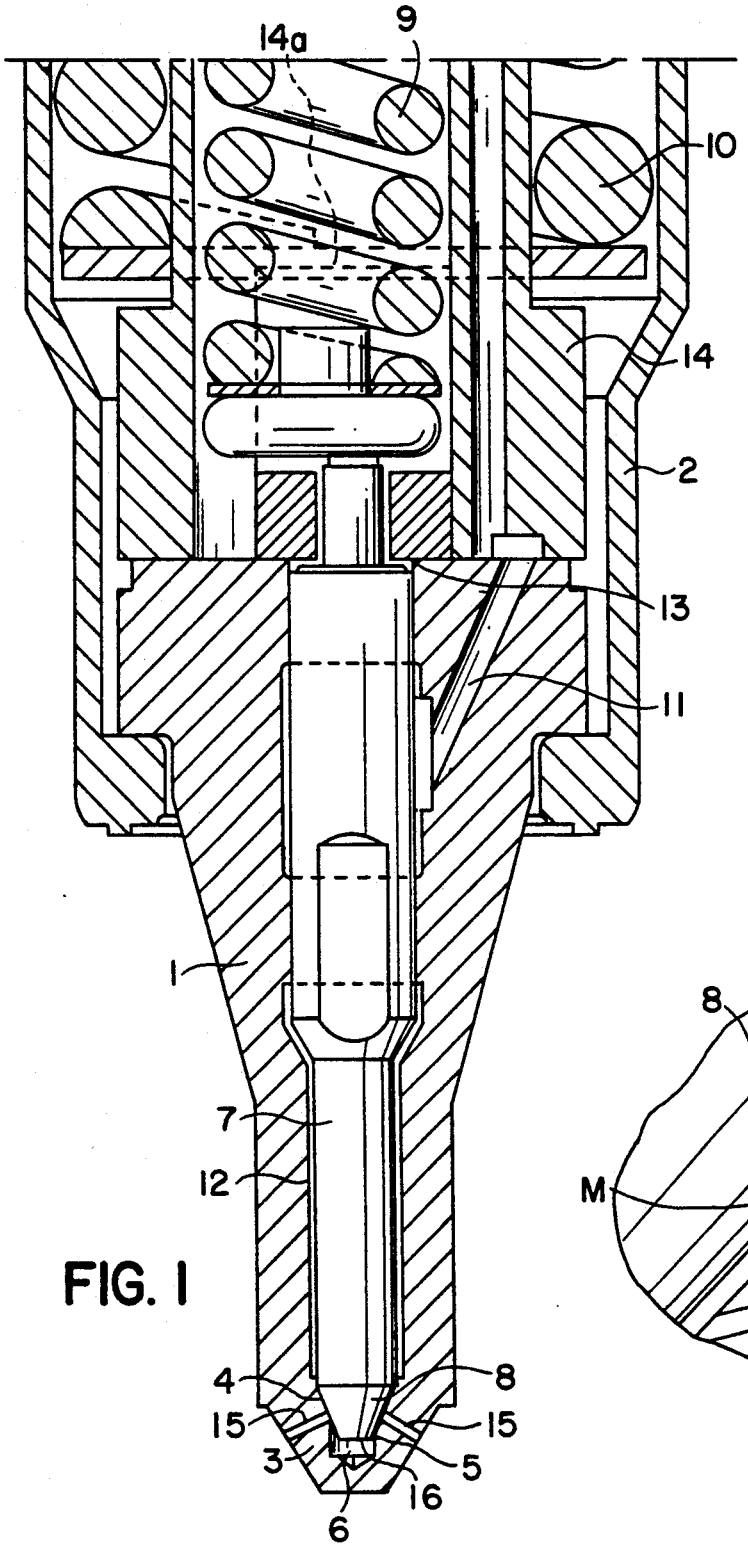
FIG. 1
FIG. 2
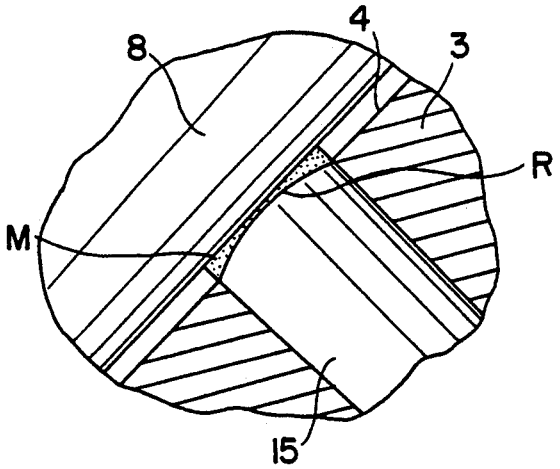

FUEL INJECTOR FOR INTERNAL COMBUSTION ENGINES

This is a continuation of U.S. patent application Ser. No. 568,470, filed Aug. 16, 1990, now abandoned.

FIELD OF THE INVENTION

This invention relates to a fuel injector of the multi-hole type for internal combustion engines, which injector comprises a nozzle body having at one end a hollow nozzle tip and a pintle which is guided in the nozzle body, wherein the nozzle tip is formed on its inside surface with a conical valve seat, and wherein the pintle has adjacent the valve seat a conical valve surface which cooperates with the valve seat and is spring-urged against the valve seat. The nozzle tip is also formed adjacent the valve seat With at least one discharge bore which is covered by the conical valve surface of the pintle when the valve is closed. The nozzle body of the fuel injector is formed with an inwardly open blind bore and with a first sharp edge between the blind bore and the small end of the conical valve seat, and the pintle is formed with a second sharp edge, by which said conical valve surface is terminated at its small end adjacent to said blind bore.

DESCRIPTION OF THE PRIOR ART

A fuel injector of this general type is already known from U.S. Pat. No. 4,715,541, which is commonly assigned with the present application. In this known fuel injector, the disposition of the discharge bores, however, is arbitrary; in other words no relationship is specified between the entrance opening of each discharge bore and the first and second sharp edges, or between the entrance openings of the discharge bores themselves. As a result, undefined and non-optimized fuel streams are directed towards the blind bore causing irregularities in flow, speed and direction around the entrance openings and therewith provide for unfavorable flow conditions and low flow speeds. These partial streams of decelerated flow which will hardly tend to develop turbulence are detrimental to atomization.

In another fuel injector, known from DE-OS 27 11 350 and U.S. Pat. No. 4,168,804, two rows of discharge bores are provided, one in the cylindrical part and one in the conical part of the nozzle body. In a first lifting phase, only the bores nearest to the tip are opened, whereas the more distant bores are opened in a second lifting phase. Two springs compressed first one and then both are intended to enable the two rows of bores to be opened consecutively. It is a disadvantage of this known design, however, that the opening of the more remote bores by a sliding member causes a wobbling fuel jet, a spread of the onset of injection from bore to bore, and a jog in the characteristic curve of the injection, all these causing irregularities of combustion and noise.

SUMMARY OF THE INVENTION

For this reason it is an object of the invention to eliminate said disadvantages and to provide a fuel injector which is of the kind described first hereinbefore and which is so improved with simple means that a higher degree of atomization is achieved in a first lifting phase, and optimized atomization with sufficient penetration is achieved in a second lifting phase.

That object is accomplished in that the fuel injector is constructed so that when the valve is closed, the shortest distance from the center of the entrance opening of at least one of the discharge bores to the nearer of the first and second sharp edges is not in excess of one and one-half times the diameter of the entrance opening, and the shortest distance from the center of said entrance opening to the other of said first and second sharp edges is equal to or larger than one and one-half times the diameter of the entrance opening.

The arrangement of the centers of the entrance openings of the discharge bores at specified distances from the first and second sharp edges has the result that the flow between the entrance openings will reach the sharp edges with sufficient speed to create a vortex in the blind bore and even to return upwards to the lower perimeter of the entrance openings with sufficient speed to create equal and equally turbulent flow conditions around the entire entrance opening of the bore. Upon these equally distributed vortices are then superposed second vortices caused by the sharp deflection upon entry into the discharge bores. All this improves atomization and fuzziness of the injected fuel considerably.

Prerequisite for this are the sharp edges between the blind bore and valve seat and between the blind bore and pintle in order to influence the flow pattern, flow separation being involved.

Similar results will be produced if the discharge bores are spaced apart from each other by specified small distances because in that case the entrance openings of the bores will be fairly closely spaced to each other and the otherwise occurring laminar flows of the fuel between the entrance openings will thus be inhibited and a retarded flow resulting in a non-uniform atomization need not be feared. The smaller the distance between the entrance openings of the discharge bores, the faster will be the flow between said entrance openings so that the flow to the blind bore will be improved and accelerated and a more favorable backflow from the blind bore will be obtained. That result will be produced with very simple technical means because it will be sufficient to provide the discharge bores at specified locations in relation to each other.

The invention is particularly beneficial in fuel injectors in which the pintle performs a two-phase lifting stroke, as is disclosed in U.S. Pat. No. 4,715,541. In that case the pintle will be only slightly lifted from the valve seat in the first lifting phase which may have any desired duration and will establish only a small gap for the flow of fluid so that the desired conditions of flow will be created adjacent to the discharge bores and a uniformly and well defined atomization will result. As the gap for the flowing fuel and the fuel supply rate increase, the influence which can be exerted by the sharp edges and the holes on the conditions of flow will decrease but will still enhance marginal atomization, without prejudice to penetration in the second lifting phase, where the section of the generated surface exceeds, as is customary with this type of nozzle, 133% of the cross-section of the discharge bores.

By choosing the distance between the discharge bores as defined, a similar effect is obtained because the reduced distance between the bores prevents slow partial flows between the discharge bores and consequently a slow return flow from the blind bore which would lead to unequal speed distribution around the entrance openings and to unequal atomization. The shorter the distance between the entrance openings, the higher the flow speed between them will be and the result will be an accelerated and sharply deflected flow into the blind bore and accordingly a fast and turbulent return flow from the blind bore. This beneficial flow pattern is achieved with the most simple technical means, i.e., the mere choice of the location of the discharge bores.

In a preferred arrangement, an imaginary cylinder which constitutes a continuation or projection of each discharge bore and extends from the edge of the entrance opening of said bore to the valve surface of the pintle when it has been lifted from the valve seat in the position assumed at the end of the first lifting phase, has a peripheral surface area which is about 15 to 50% of the cross-sectional area of the discharge bore. That arrangement will result in particularly desirable conditions because a throttling will be effected only adjacent the discharge bores and the desired influence of the sharp edges and of the entrance opening spacings on the atomization will be obtained most effectively.

A plurality of discharge bores will usually be provided and they will all be arranged to meet the requirements specified by the invention. Alternatively, an advantage may also be afforded by an arrangement in which said requirements are met by only one discharge bore or by only some of the discharge bores, whereas the relationships between the remaining discharge bores and the sharp edges provided on the end portion of the pintle and at the end of the valve seat are not specified. This may be the case when the fuel injection nozzle is provided in a highly eccentric arrangement adjacent to a large combustion chamber of an internal combustion engine.

In that case, it is desired to discharge finely atomized fuel from that discharge bore which is directed toward that surface of the combustion chamber which is closest to the tip of the fuel injector and this is achieved in that said discharge bore is arranged as is specified by the invention. A different design and arrangement is provided for the discharge bores which are directed towards the remote surface of the combustion chamber so that the fuel jets discharged from said other discharge bores will have a long range and will reach said remote surface of the combustion chamber.

Said different discharge conditions can be established in a simple manner in accordance with the invention in that at least part of the second sharp edge which is formed on the pintle at the end of its conical valve surface deviates from a plane that is perpendicular to the axis of the pintle and the pintle is guided so as to resist rotation. In this manner, the portions of said edge which are associated with different discharge bores have different configurations, and different conditions will be obtained for the flow of fuel to different discharge bores and for the discharge of fuel from said discharge bores. This can be achieved by shaping the upper part of the pintle and the corresponding guiding surfaces in the nozzle body with either a non-circular cross-section (e.g., a polygon with rounded edges or a trochoid), or with at least one axially directed nose meshing with a corresponding recess.

It is within the scope of the invention that the edge of the lifted pintle extends beyond the lowest part of the entrance openings of the discharge bores. If this is also the case in the second lifting phase, the aforementioned marginal atomization without reduced penetration is achieved.

Optimized flow conditions will prevail when the generatrices of the conical valve seat and the blind bore form an angle between 120° and a maximum of 145°. This provides for flow separation without dead water zone and their inherent risk of cavitation.

BRIEF DESCRIPTION OF THE DRAWINGS

FIG. 1 is a simplified axial sectional view showing those parts which are essential in a fuel injector of the present invention having a two-phase lifting stroke.

FIG. 2 shows on a larger scale as a detail the region adjacent to one discharge bore.

DETAILED DESCRIPTION OF THE PREFERRED EMBODIMENTS

Figure 3:
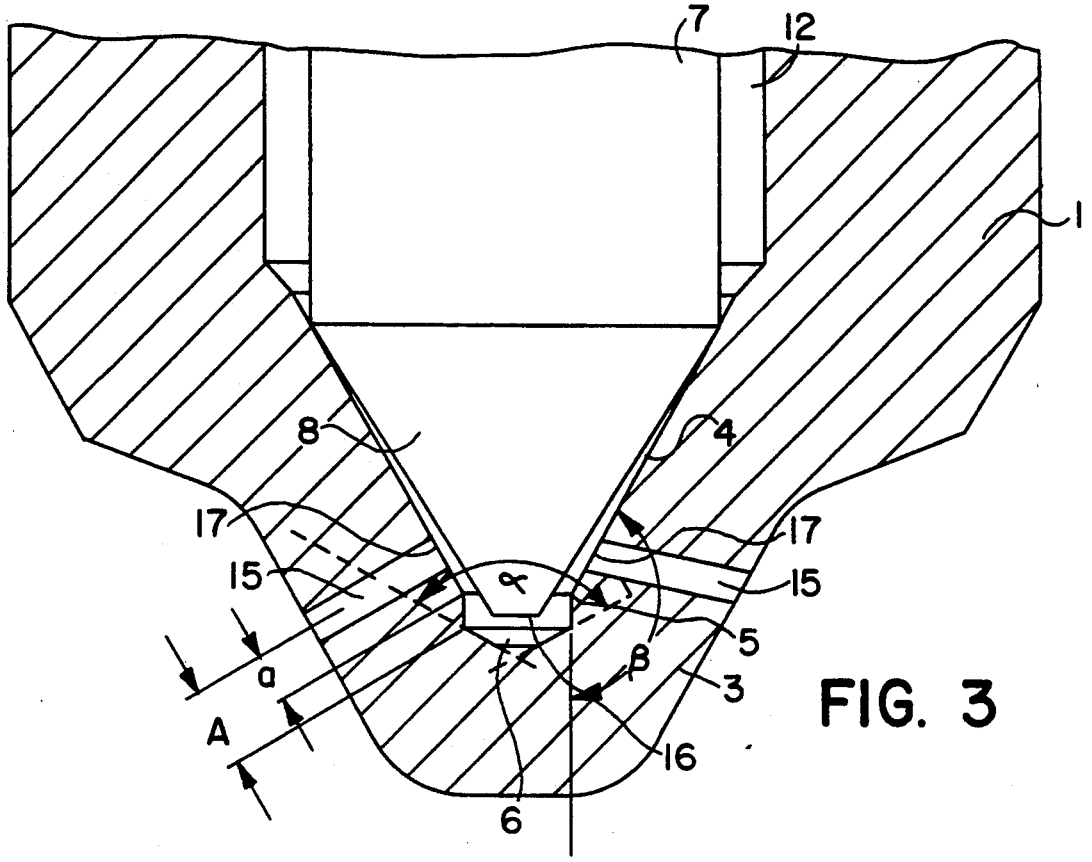
FIG. 3 is an axial sectional view showing on a larger scale an embodiment of the invention wherein the pintle is forced against the valve seat.

Referring to FIGS. 1, 2, and 3, a nozzle body 1 is fixed by a cap nut 2 to a nozzle holder of the inventive fuel injector and is provided at its bottom end with a nozzle tip 3, which is formed on its inside surface with a conical valve seat 4 and with a blind bore 6, which is separated from the valve seat 4 by a first sharp edge 5 having an angle $\beta$ of approximately 145° (see FIG. 3). A pintle 7 is biased downward by a first relatively weak spring 9, which is surrounded by a much stronger second spring 10. A fuel pump, not shown, supplies fuel to a passage 11 that is formed in the nozzle body 1, and from the passage 11, fuel enters a clearance space 12, which surrounds the pintle 7 and conducts the fuel to the valve seat 4.

In response to a rising discharge pressure of the fuel pump, the pintle 7 and specifically its conical valve surface 8 is lifted against the force of the spring 9 from the valve seat 4 until the pintle 7 engages the bottom face of a stop 13, which is biased downwardly against the top surface of the nozzle body 1 by the spring 10. This is the first lifting phase During this first lifting phase, the surface area of an imaginary cylinder formed as a continuation of the discharge bore (see FIG. 2) is less than 75% of the cross-sectional area of the discharge bore, and preferably constitutes only about 15 to 50% of the cross-sectional area of the discharge bore. As the fuel pressure increases further, the stop 13 is lifted against the force of the spring 10 until the stop 13 engages an internal shoulder 14*a* of a sleeve 14 which is mounted on top of the nozzle body 1 and surrounds the top end portion of the pintle 7, the stop 13 and the spring 9. Owing to this arrangement, the pintle 7 is lifted in two lifting phases.

The hollow nozzle tip 3 is formed adjacent to the valve seat 4 with discharge bores 15, which have entrance openings 17 and which are formed in the valve seat 4. When the valve is closed (as shown in FIG. 3), the entrance openings 17 are covered by the conical valve surface 8 of the pintle 7. The valve surface has at its lower end a second sharp edge 16.

As is apparent from FIG. 2, when the pintle 7 has performed the first phase of its stroke, an imaginary cylinder M is obtained as a continuation of each discharge bore 15 from the entrance opening thereof to the conical valve surface 8 and said imaginary cylinder M has a peripheral surface area amounting to less than 75%, and preferably, to only 15 to 50%, of the cross-sectional area of the discharge bore 15 so that the flow of fuel will not be throttled until it enters the discharge bores 15.

It is apparent from FIG. 3 that the distance a from the center of the entrance opening 17 of each discharge bore 15 to the first sharp edge 5 at the top end of the blind bore 6 is somewhat smaller than one and one-half times the diameter of the entrance opening 17. When the valve 4,8 is closed, the distance A from the center of each of said entrance openings 1 to the second sharp edge 16 on the pintle 7 is larger than one and one-half times the diameter of the entrance opening 17.

Figure 4:
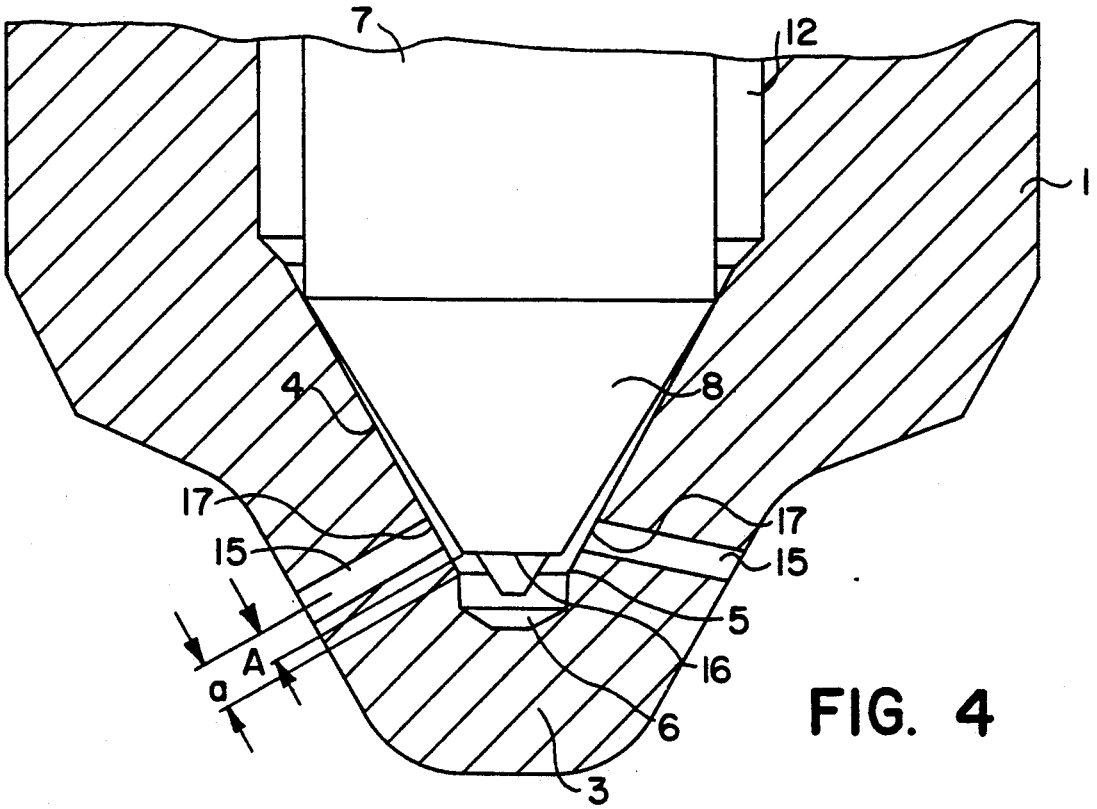
FIGS. 4 and 5 are views which are similar to FIG. 3 and illustrate two modifications of the present invention.

The design shown in FIG. 4 differs from the one shown in FIG. 3 only in that the distance a from the center of the entrance opening 17 of each discharge bore 1 to the first sharp edge 5 of blind bore 6 exceeds the distance A from said center to the second sharp edge 16 of the pintle 7. In this design, the distance A is not in excess of one and one-half times the diameter of the entrance opening 17. In front of the edge 16 there is provided a truncated cone.

Figure 5:
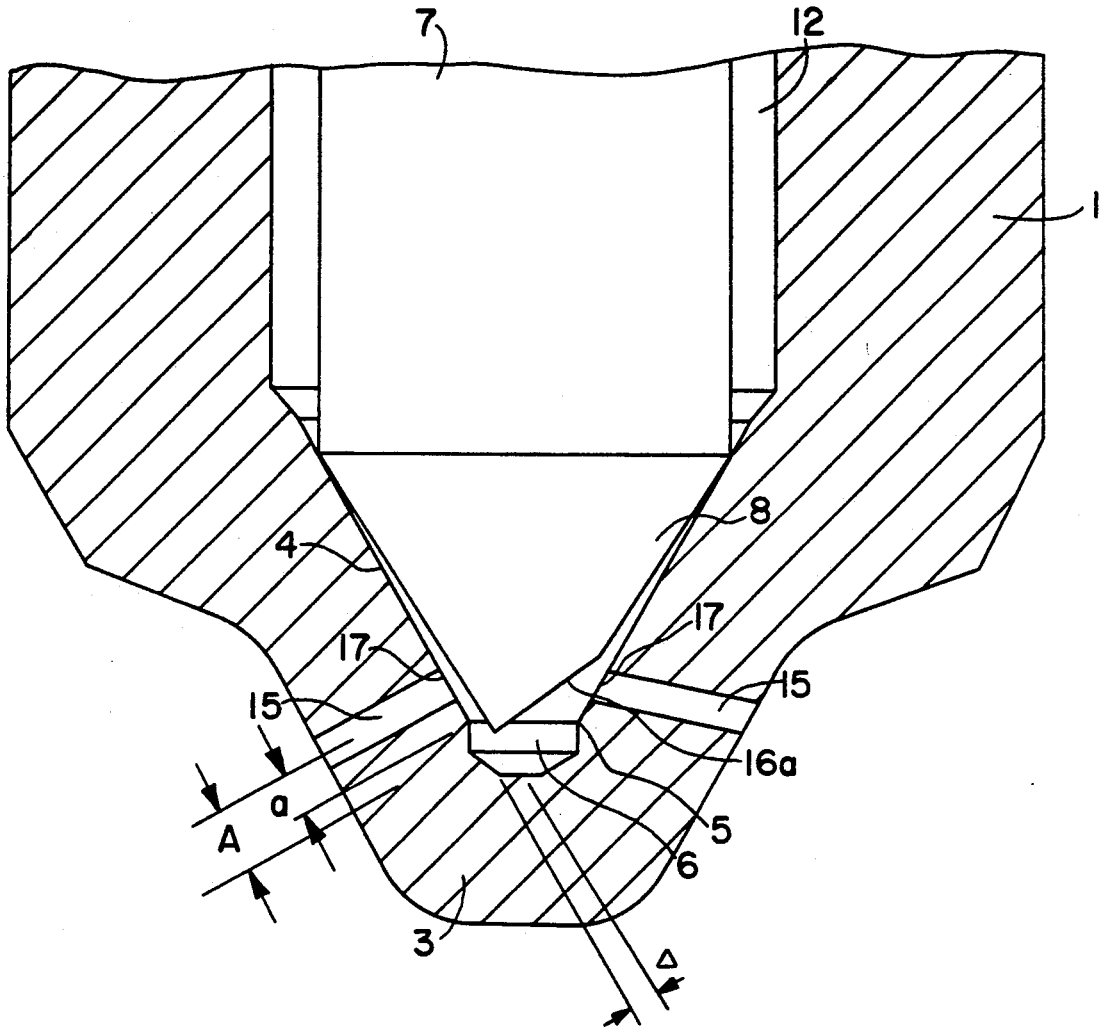

In the illustrative embodiment shown in FIG. 5, the second sharp edge 16*a* of the pintle 7 extends in a plane which is inclined from the axis of the pintle so that the relationships of the distances specified hereinbefore are met only by the entrance opening 17 of the discharge bore 15 which is shown on the left but are not met by the entrance opening 17 of the discharge bore 15 that is shown on the right and will not be covered by the conical valve surface 8 when the valve is closed. As a result, specified different conditions are obtained for the discharge of fuel through the two discharge bores 15.

FIG. 5 further shows an acute angle Δ between, for instance, 0.2 and 1° formed between the generatrices of the conical valve seat 4 and the tip 8 of the pintle. This improves good sealing, precisely above the discharge bore.

Figure 6:
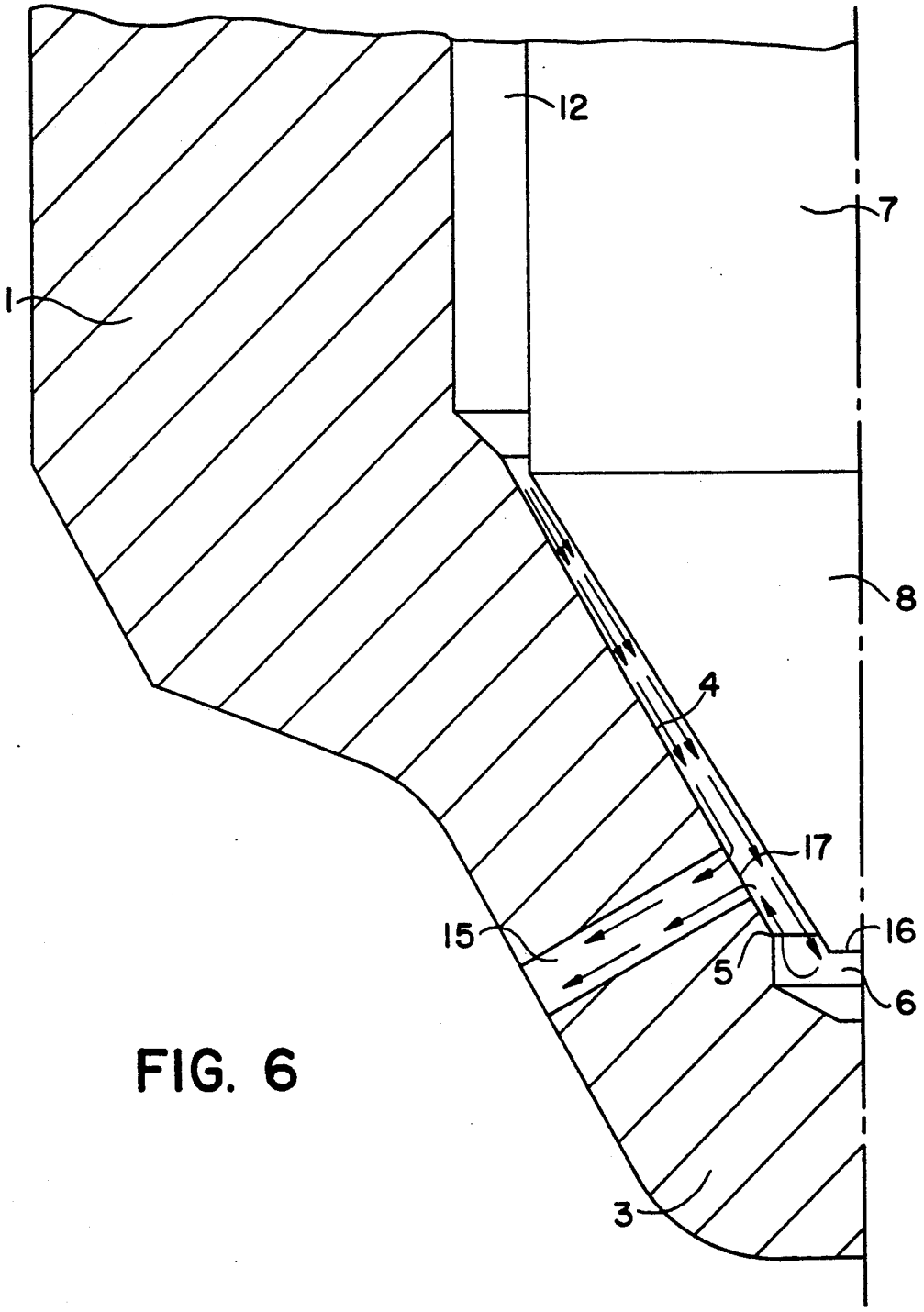
FIG. 6 is a further enlarged view showing the end portion of the nozzle body with the pintle lifted from the valve seat after the first stroke phase and with an indication of the flow of fuel.

In FIG. 6, arrows indicate the flow of fuel when the pintle 7 and specifically its valve surface 8 has been lifted from the valve seat 4 after the first lifting phase. It is apparent that in said first lifting phase, in which only a narrow gap is opened between the valve surface 8 and the valve seat 4 and only a thin film of fuel can flow to the entrance openings of the discharge bores 15, the first and second sharp edges 5 and 16 will essentially contribute to the acceleration and turbulencing of the fuel adjacent to the entrance opening 17 of the discharge bore 15.

Figure 7:
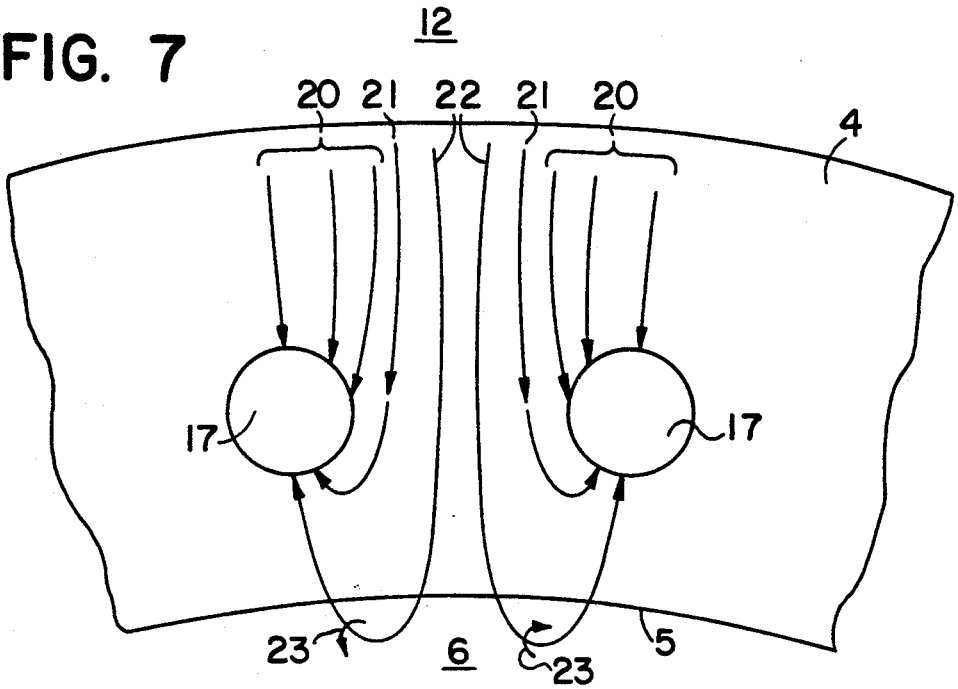
FIG. 7 is a developed view showing the valve seat formed by the hollow nozzle tip and an indication of the flow of fuel.

The resulting flow conditions in the first lifting phase are clearly apparent in the development of the valve seat illustrated in FIG. 7: Fuel enters from the clearance space 12 in the space between conical valve seat 4 and conical tip 8 of the pintle 7. The stream lines 20 lead evenly distributed to the upper part of the entrance openings 17, some being noticeably deflected. The stream lines 21 going beyond an imaginary line between the centers of the entrance openings 17, are deflected by more than 90°.

The stream lines 22 are of sufficient distance from the entrance openings to reach the edge 5, are deflected into the blind bore 6 whereby secondary vortices 23 are created further deflected in the blind bore 6, and return past the edge 5 to the lower part of the entrance openings 17. With the distance between the entrance openings 17,17 and between the entrance openings 17 and the edges 5,16 according to the invention, a turbulent flow pattern equally distributed around the entrance openings 17 is assured.

FIG. 6 further shows clearly that the edge 16 of the conical part 8 of the lifted valve pintle 7 is lower then the lower part of the entrance opening 17 of the discharge bore 15. This provides for a sharp deflection of the fuel all around the entrance opening 17 and improves atomization.

Figure 8:
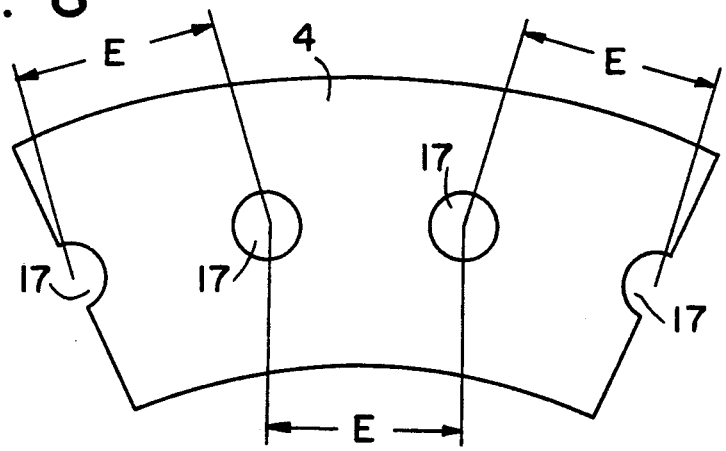
FIGS. 8 and 9 are views which are similar to FIG. 7 and illustrate possible arrangements of the entrance openings of the discharge bores.
Figure 9:
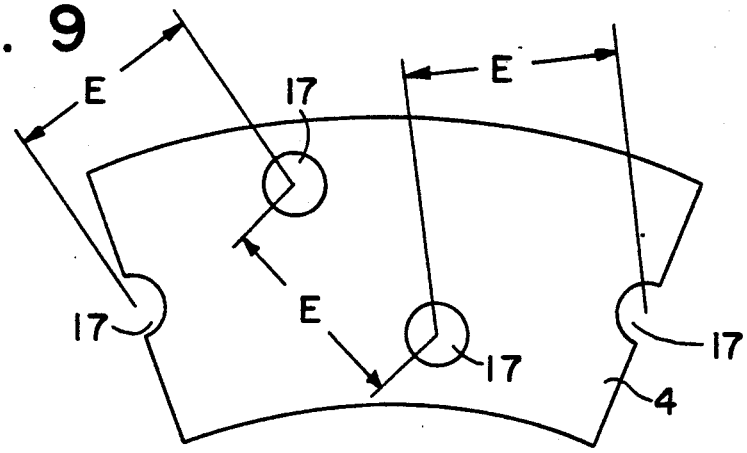

FIGS. 8 and 9 show a development of the valve seat 4 and illustrate that the distance E between the centers of the entrance openings 17,17 measured on the valve seat 4, is not in excess of three and one-half times the diameter of the entrance openings 17 or, if said entrance openings 17 differ in diameter, the distance E is not in excess of three and one-half times the smallest diameter of the entrance openings, so that the atomization of the fuel which is discharged will be further improved. This holds true whether the entrance openings are distributed in a line along conical valve seat 4 (FIG. 8), or are staggered (FIG. 9).

A feature common to all illustrated embodiments of the invention is that the blind bore 6 terminates in a truncated cone. Thus, conical valve seat 4 forms a sharp edge 5 with the blind bore 6, which in turn forms a third sharp edge with the truncated cone, the angle α (FIG. 3) being 120° to 145°, preferably approximately 135°. These pronounced edges have an additional beneficial effect on fuel flow.

While the invention has been described by reference to specific embodiments, this was for purposes of illustration only and should not be construed to limit the spirit or the scope of the invention.

What is claimed is:

1. A fuel injector for an internal combustion engine, comprising a nozzle body having a hollow nozzle tip at one end of said nozzle body, said hollow nozzle tip having an inside surface constituting a conical valve seat which narrows to a first small end, said hollow nozzle tip terminating in a blind bore adjacent to said small end, a first sharp edge being formed between said first small end and said blind bore, said hollow nozzle tip further including a plurality of discharge bores each having an entrance opening, a pintle mounted in said nozzle body for movement along an axis of said nozzle body, said pintle having a conical valve surface which cooperates with said conical valve seat to form a valve, said pintle narrowing to a second small end and a second sharp edge in the region of said blind bore, said pintle being axially movable between a closed position wherein said pintle covers at least one of said entrance openings and engages said valve seat, and an open position wherein said entrance openings are uncovered, and biasing means acting on said pintle and urging said pintle towards said closed position, wherein when said pintle is in said closed position, the distance from the center of said entrance opening to the nearer of said first and second sharp edges is not in excess of one and one-half times the diameter of said entrance opening, and the distance from the center of said entrance opening to the farther of said first and second sharp edges is at least one and one-half times the diameter of said entrance opening.

2. The fuel injector set forth in claim 1, wherein said second sharp edge is within a plane that is normal to an axis of said pintle.

3. The fuel injector set forth in claim 1 further comprising means for resisting rotation of said pintle, and wherein said second sharp edge at least in part deviates from a plane that is normal to an axis of said pintle.

4. The fuel injector set forth in claim 1, wherein the distance between the centers of said entrance openings measured along said inside surface of said valve seat is not in excess of three and one-half times the diameter of said entrance openings.

5. The fuel injector set forth in claim 1, wherein said pintle is movable away from said closed position in first and second lifting phases.

6. The fuel injector set forth in claim 1, wherein said biasing means comprises first and second springs opposing the movement of said pintle away from said closed position, said nozzle body being formed around said pintle with a clearance space for receiving fuel under pressure, said pintle being movable away from said closed position by the pressure of the fuel in said clearance space against the force of said first spring in a first lifting phase, and a stop which is axially movable by said pintle in a second lifting phase against the force of said first and said second springs, said stop being engaged by said pintle when said pintle has been moved away from said closed position to a predetermined intermediate position.

7. The fuel injector set forth in claim 6, wherein an imaginary cylinder constitutes an extension of said discharge bore between said entrance opening and said valve surface when said pintle is in said intermediate position, and wherein said imaginary cylinder has a peripheral surface area which is less than 75% of the cross-sectional area of said discharge bore.

8. The fuel injector set forth in claim 7, wherein said imaginary cylinder has a peripheral surface area which is about 15 to 50% of the cross-sectional area of said discharge bore.

9. The fuel injector set forth in claim 1, wherein an acute angle between about 0.2 and 1.0° is formed between said first small end of said valve seat and said second small end of said pintle.

10. The fuel injector set forth in claim 1, wherein the second sharp edge of said pintle extends past said entrance opening of said discharge bore when said pintle is in said open position.

11. The fuel injector set forth in claim 1, wherein generatrices of said conical valve seat and said blind bore form an angle of less than about 145°.

12. The fuel injector set forth in claim 1, wherein said blind bore terminates in a truncated cone having sides which form an angle therebetween of 120° and 145°.

* * * * *